US006238001B1

(12) United States Patent
Yoran

(10) Patent No.: US 6,238,001 B1
(45) Date of Patent: May 29, 2001

(54) ADJUSTABLE CHAIR

(76) Inventor: Amos Yoran, 12 Beer Tuvia St., 64583 Tel Aviv (IL)

( * ) Notice: Subject to any disclaimer, the term of this patent is extended or adjusted under 35 U.S.C. 154(b) by 0 days.

(21) Appl. No.: 09/280,397

(22) Filed: Mar. 29, 1999

(30) Foreign Application Priority Data

Sep. 30, 1996 (IL) ..... 119330

(51) Int. Cl.[7] ..... A47C 1/02
(52) U.S. Cl. ..... 297/316; 297/354.12
(58) Field of Search ..... 297/316, 320, 297/323, 325, 359, 360, 362.12, 362.13, 354.12, 326, 327, 344.18, 356, 411.44, 452.12, 452.13, 452.63

(56) References Cited

U.S. PATENT DOCUMENTS 513,584 * 1/1894 Leisenring .
2,655,200 * 10/1953 Lorenz .
3,142,512 * 7/1964 Hamilton et al. .
3,565,482 * 2/1971 Blodee .
3,870,365 * 3/1975 Knutsen .
3,877,750 * 4/1975 Scholpp .
4,164,356 * 8/1979 Knight .
4,514,009 * 4/1985 Vanderminden et al. .
5,611,594 * 3/1997 Findlay .

FOREIGN PATENT DOCUMENTS 0 677 260 A1 2/1995 (EP) .
111987 12/1917 (GB) .
1403648 8/1975 (GB) .

* cited by examiner

*Primary Examiner*—Milton Nelson, Jr.
(74) *Attorney, Agent, or Firm*—Foley, Hoag & Eliot LLP

(57) ABSTRACT

A chair comprising a base, an adjustable frame supported by said base, a seat and a back. The chair is characterized in that the adjustable frame is swingable with respect to the base, preferably about a substantially horizontal axis, and comprises telescopic arms, in that the seat and the back are swingably connected to one another, and in that the seat and the back are connected to said telescopic arms, whereby adjustment of these latter permits one to vary the inclination of the seat and back. Preferably, the inclination of said seat and back vary in such a way that the center of gravity of the user's body is located at or near the line of application of the resultant of the reactions of the floor on the seat base.

15 Claims, 4 Drawing Sheets

ADJUSTABLE CHAIR

RELATED APPLICATIONS

This is a continuation of International Application No. PCT/IL97/00310 with an international filing date of Sep. 30, 1997, the entire disclosure of which is hereby incorporated herein by reference.

FIELD OF THE INVENTION

This invention relates to chairs, which can be adjusted to assume a variety of positions for rest, for writing at a desk, and so forth.

BACKGROUND OF THE INVENTION

A very large number of chair structures are known in the art, which are adjustable to permit the body of the user to assume a variety of positions, such as a reclining position for rest, a sitting position for writing at a desk and so forth. Many of said structures comprise a number of articulated parts, which swing relative to one another as the chair is adjusted from one position to another. Some of those chairs comprise a base, often in the form of a pedestal having a central column and a plurality of legs, to which the main structure of the chair is connected, by means of pivots, universal joints or the like. In some cases elastic elements are provided in the structure, whereby the chair may oscillate about a mean position, for the user's greater comfort. The last mentioned structures, however, generally do not permit the user to assume a reclining position and are capable of only limited angular displacement. In any case, structures that are widely adjustable and satisfactory from the viewpoint of the positions which they may assume, are complicated and relatively expensive to build.

It is a purpose of this invention to provide a chair which can be adjusted to assume practically any position that the user may desire, and yet is extremely simple in structure and economical to build.

It is another purpose of this invention to provide such a chair in which the user can assume either a substantially completely reclining position, or a sitting rest position, or a position adapted for writing at a desk.

It is a further purpose of the invention to provide such a chair, the structure of which comprises a minimal number of joints and particularly of pivots.

It is a still further purpose of the invention to provide such a chair which has a plurality of equilibrium positions coordinated to the position of the body of the user.

It is a still further purpose of the invention to provide such a chair which provides maximum comfort with the utmost structural simplicity.

Other purposes of the invention will become apparent as the description proceeds.

SUMMARY OF THE INVENTION

The aforesaid purposes are attained by a chair according to the invention, which comprises a base, an adjustable frame supported by said base, a seat and a back, and is characterized in that the adjustable frame is swingable with respect to the base, preferably about at least a substantially horizontal axis, and comprises telescopic arms, in that the seat and the back are swingably connected to one another, and in that the seat and the back are connected to said telescopic arms, whereby adjustment of these latter permits to vary the inclination of the seat and back. Preferably, the inclination of said seat and back vary in such a way that the center of gravity of the user's body is located at or near the line of application of the resultant of the reactions of the floor on the seat base.

In preferred forms of the invention, the adjustable frame comprises a preferably fork-shaped support, which is swingably supported by the base or by a joint coupled to the base. Preferably, also, the telescopic arms each comprise a preferably tubular casing connected to said support and front and back sliders housed in said casing and slidable therein to vary the length of the arm. Also preferably, the seat and back comprise a frame having a rigid seat portion and a rigid back portion connected in adjustable angular positioned relationship, preferably by means of pliable joint elements. Preferably the seat is connected to the telescopic arms casings, in the vicinity of their front ends, and the back is swingably connected to the back sliders, whereby variations of the length of the telescopic arms produces relative swinging motions of the seat and back. Preferably the chair according to the invention also comprises a head rest connected to the back, preferably in adjustable angular positioned relationship, e.g. through pliable joint elements. Also preferably, means are provided for angularly blocking the support relative to the base. The telescopic arms may serve as arm rests or support such rests.

Other features of the invention will appear as the description proceeds.

BRIEF DESCRIPTION OF THE DRAWINGS

The invention will be better understood with reference to the appended drawings, wherein.

DETAILED DESCRIPTION OF PREFERRED EMBODIMENT

With reference now to the drawings, numeral 10 generally indicates a base, which in the embodiment described is composed of a column 11 and five legs 12, but could have any desired structure, since it is not a part of the invention and, as to itself, is conventional. The base is provided, if desired, with elements 13, spherically or otherwise shaped, to permit the chair to slide across the floor.

Figure 3:
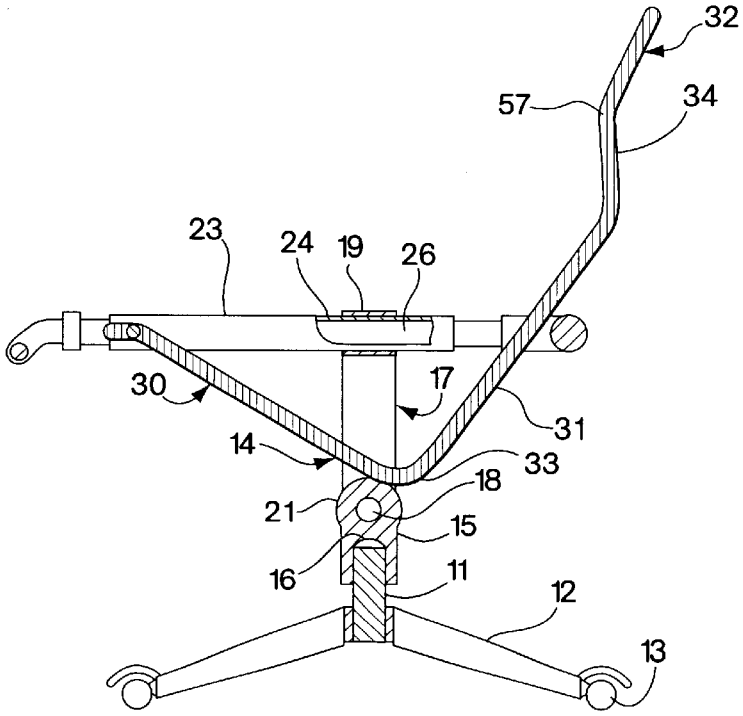
FIG. 3 is a side view of the chair in the position of FIG. 1.

The base, whatever is structure may be, is connected to an adjustable frame generally indicated at 14. In the embodiment described, the frame comprises a connector 15 having a vertical sleeve 16 (best seen in FIG. 3) which fits on the column 11 of the base, and to which a fork-shaped support 17 is pivotally connected, as hereinafter described, so as to be swingable about a substantially horizontal axis, Alternatively, the support could be pivoted directly to the base. It is only desirable that the upper portion of the frame 14, which supports the seat, the back and the telescopic arms to be described, be swingable about such an axis with respect to the base, and this can be accomplished in a number of mechanically equivalent manners. The frame 14 may also be rotatable with respect to the base about a vertical axis, though this is not necessary. Thus, optionally, the connector 15 could be made rotatable about the axis of the column 11, to permit the chair to assume any desired angular position with respect to the base. In any case, means, not shown, may be provided to permit the frame 14 to be raised or lowered and blocked at any desired height by means, such as screws or the like, that are conventional in the art. The support 17 is preferably fork-shaped and comprises two branches, 19 and 19', and a central portion 18 connecting the two and disposed substantially horizontally. The central portion 18 is rotatably received in a horizontal bearing 21 of the connector 15. This has the purpose of permitting the branches 19–19' and the portions of the chair which they support to swing above a horizontal axis with respect to the base. The same result could be achieved, of course, by pivotally connecting the entire frame 14 to the base, through a horizontal pivot or other means, such as a universal joint. This sort of connection is conventional in easy chairs. Elastic elements, not illustrated, may be provided to create an elastic reaction to any swinging motion of the frame 14 or portions thereof with respect to the base. Such means need not be illustrated, since they too are conventional in the art.

To each of the branches 19–19' there is connected a telescopic arm generally indicated at 23–23'. In the embodiment described, each of these comprises a cylindrical housing 24–24', which is rigidly fixed to the respective branch 19–19' of the support, in which are slidably inserted front sliders 25–25' and rear sliders 26–26'. In the embodiment described, the front and the rear sliders can slide independently within the tubular housings 24–24', but it would not be outside of the scope of the invention to connect them so that the displacements should be equal or otherwise related. The displacements of the sliders can be obtained by hydraulic means, which means would also be effective to hold the sliders in position. Independent clamp means, however, could always be provided to hold the sliders in position, which clamp means need not be illustrated, as they are conventional. The front sliders are conveniently connected by a crossbar 37, which serves as a foot rest.

Figure 6:
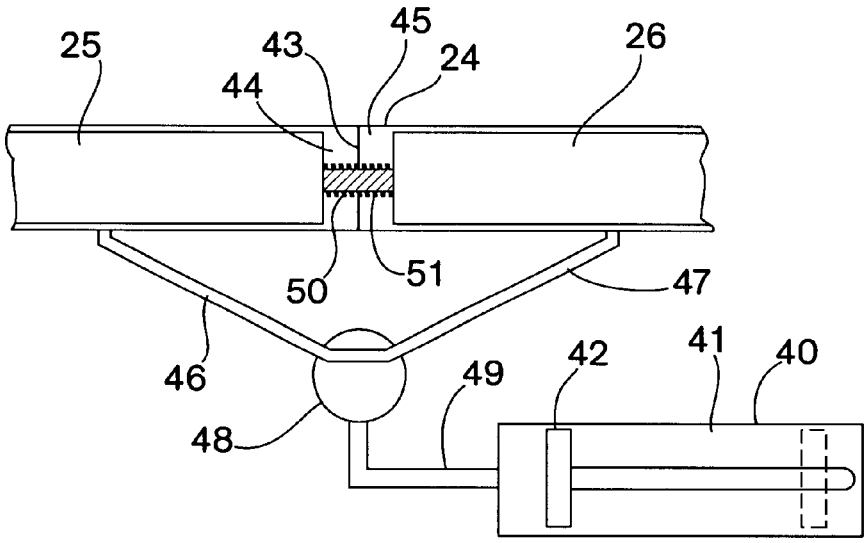
FIG. 6 schematically illustrates hydraulic means for actuating the telescopic arms of the chair, according to embodiment of the invention.

Hydraulic slider-actuating means are schematically illustrated in FIG. 6. Numeral 40 indicates a source of a fluid under pressure, e.g. a small cylinder 41 in which a piston 42 may slide from the position indicated in broken lines to that indicated in full lines. The piston can be actuated by hand, or by a pedal, or by means of a motor. Telescopic arm housing 24 is provided with an internal partition 43, which separates the two sections 44 and 45 thereof in which sliders 25 and 26 respectively slide. Conduits 46 and 47 lead the hydraulic pressure fluid into said sections. A valve 48 has three positions. In two of them it places conduit 49, which is connected to the outlet of cylinder 41, in communication with conduit 46 or 47, while in the third (shown in the drawing) it places the two conduits in communication with one another (or it seals them off). If it is not wished to actuate the two sliders independently of one another, valve 48 may be have only two positions. To return the sliders to their innermost positions in housings 24'24', piston 41 is returned to its initial position, indicated in broken lines in the drawing, either by hand or pedal or by reversing the motor which actuates it. The sliders' return may be facilitated by return springs, such as those indicated at 50–51. Alternatively, both the piston 41 and the sliders may be constructed as double effect pistons and the return of these latter to their innermost position as well be produced by hydraulic pressure. The embodiment illustrated is only schematic. In actual construction, it may be realized in many ways, and e.g. compact devices which form a part of the telescopic arms 23–23' themselves will preferably used. Telescopic devices of this kind are conventional in the art and can easily be provided by skilled persons.

Figure 7:
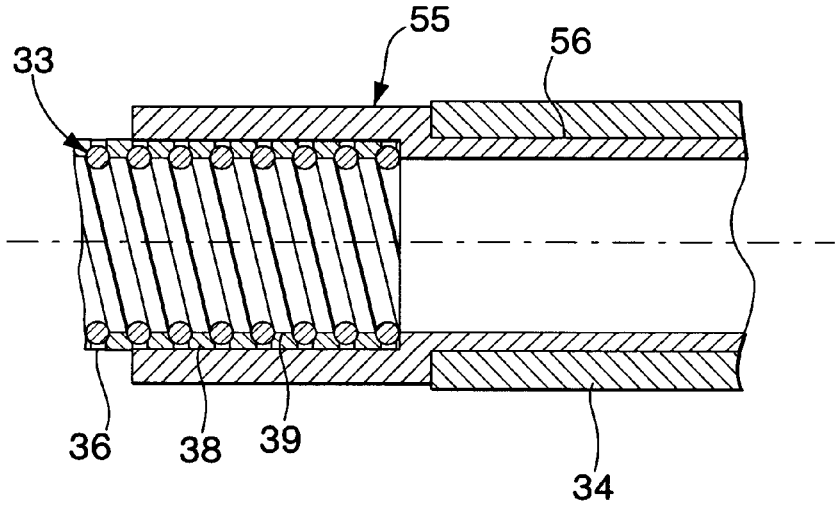
FIG. 7 is a detail of a joint connecting seat and back frame portions, according to an embodiment of the invention.

The user's body rests on a seat 30 and a back 31, to which may be connected a head rest generally indicated at 32 and having any desired structure. In the embodiment illustrated, there is provided a seat-and-back frame, having a seat portion and a back portion, each comprising two parallel ribs 34–34' and 35–35' respectively, extending longitudinally of the chair and supported by the telescopic arms, as will be explained. Said frame portions may be made of any desired rigid material, e.g. metal or plastic tubing of any suitable cross-section. Said frame portions are connected in adjustable angular relationship. In the embodiment illustrated this is done by means of pliable joints. An end portion of a tubular rib, e.g. 34, and the adjacent end portion of a pliable joint 33; are shown in cross-section in FIG. 7. The pliable joint 33 is made of a spring-like helical core 36, about which is wound a helical strip 38 of any suitable material which covers the core and penetrates, with inner projections 39, into the gaps between the core's helical turns. These elements are inserted at their end into a tubular connector 55, into which they are forced or which is crimped onto them or otherwise securely connected, and connector 55 is forced with a narrower end portion 56 into tubular rib 34 (or 35) or otherwise securely connected to it. This type of pliable connection is used in many objects (such as lamp supports) and is conventional, and in its place other conventional pliable connections, such as those made of a plurality of elements which can rotate with respect to one another, can be used.

The seat and back are completed by a flexible member 53, which is stretched transversely of the chair between the ribs 34–34' and 35–35' respectively and is supported at its forward end by a cross-bar, not visible in the drawings, which member constitutes the central part of the seat, back and head rest. Said member may consist of a flexible sheet, e.g. of plastic foil or canvas, or it may comprise a sheath filled with a viscous liquid, which better adapts to the outline of the user's body. Such liquid-filled sheaths are known in the art and used to provide a high comfort to the user, especially in seating arrangements such as used in pilot seats of certain aircraft or spacecraft and is designed to absorb extreme shocks due caused by very high accelerations.

The head rest, when provided, may have a structure similar to that illustrated for the seat and back. It may be connected to the back through a pliable portion 56, similar to the pliable connection of seat to back illustrated in FIG. 7, and may include a further pliable portion 57 to permit more perfect adjustment thereof.

The seat frame is attached at its front to the front portion of the housings 24–24' of the telescopic arms, while the back frame is attached, near its connection to the head rest or at any rate at an intermediate position, to the rear sliders 26–26', near the rear end thereof. Said connections of the seat and of the back are effected through pivots, such as 58 and 59, to permit said seat and back to swing freely with respect to the frame of the chair. Additionally, the pivots may be slidable in guide slits, such as 60, to permit more perfect adjustment of the parts supported by them.

Figure 1:
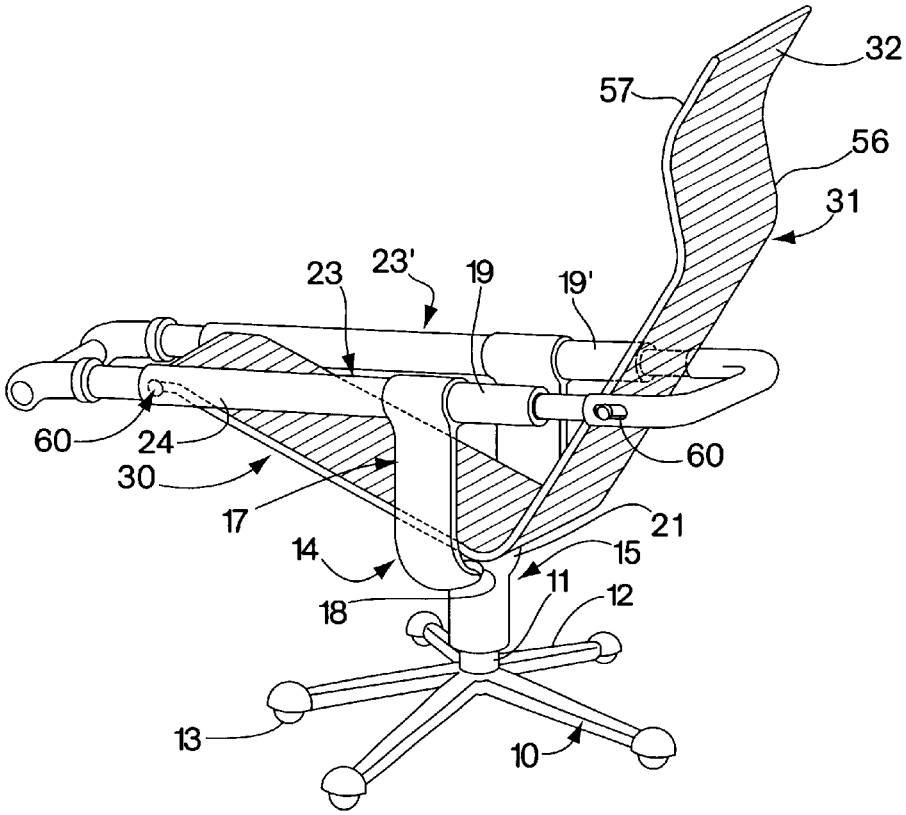
FIG. 1 is a perspective view of a chair according to the invention, seen from the side, in a sitting, rest position.
Figure 2:
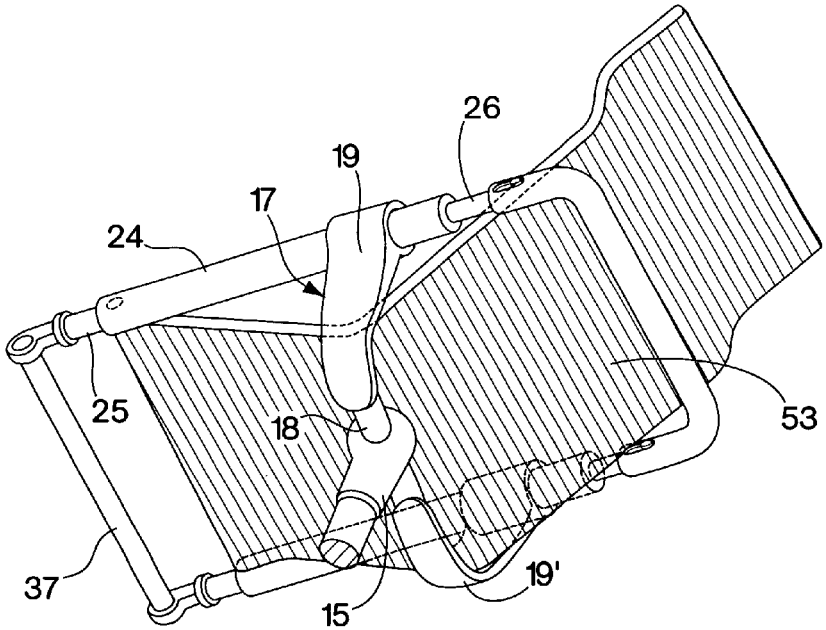
FIG. 2 is another perspective view of said chair in the same position, seen from the bottom with part of the base removed.

The operation of the described device is as follows. FIG. 1 illustrates the chair in a sitting, easy position. The front and rear sliders 25–25' and 26–26' are inserted all the way into the tubular housings 24–24' of the telescopic arms. The seat is slanted downwards from front to rear and the back is slanted rearwards, so as to permit the user to sit in a comfortable position. The head rest, if structured according to the example described, permits the user to keep his head in the most comfortable position. The telescopic arms, in this and other positions, serve as arm rests, or the housings 24–24' may support padded arm rests or the like.

Figure 5:
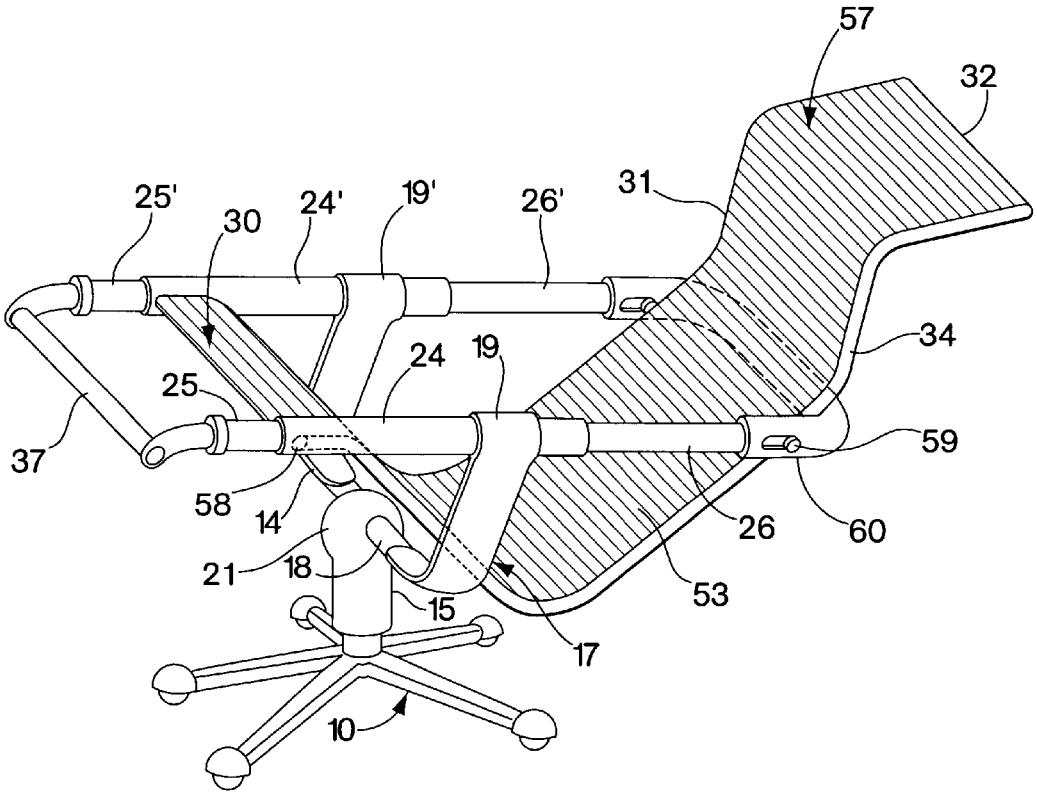
FIG. 5 is a perspective view of the same chair in a reclining position.

If the user wishes to assume a reclining position, he can actuate the rear sliders 26–26' of the telescopic arms to slide backwards, and concurrently he may cause the front sliders 25–25' to slide towards the front out of the tubular housings 24–24'. The position of FIG. 5 is thus assumed.

It will be noted that in both positions described the centre of gravity of the user's body is located substantially on the vertical passing through the axis of the column 11 of the base, or at any rate, close to the line of application of the resultant of the floor's reaction applied to the chair base. Both positions are in fact substantially equilibrium positions of the system constituted by the chair and the user's body.

Figure 4:
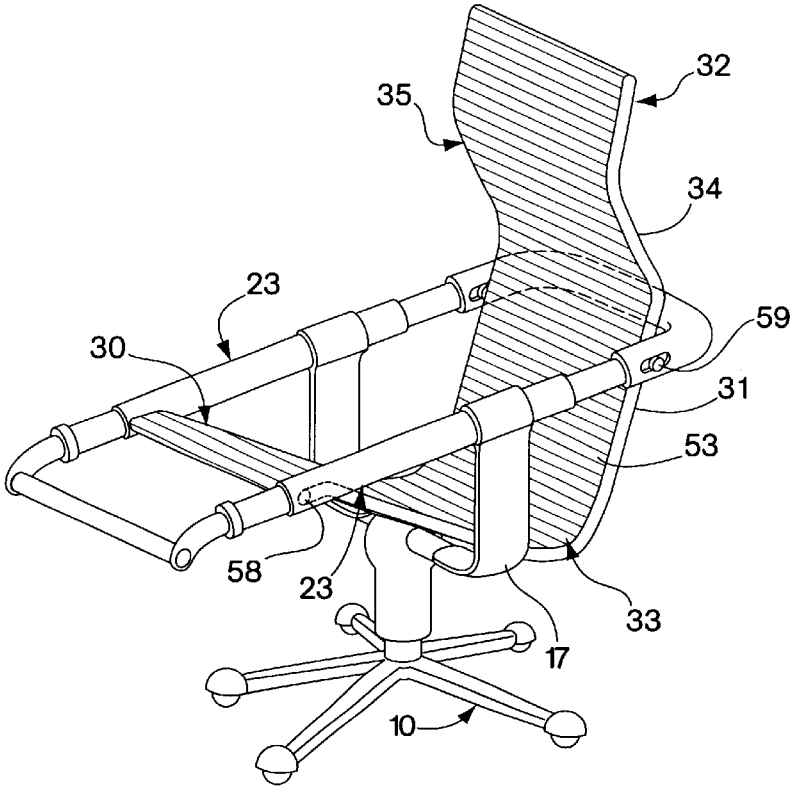
FIG. 4 is a perspective view of the same chair in a position particularly adapted for writing at a desk.

If this user wishes to write at a desk or to carry out similar activities, starting from the position that is illustrated in FIG. 1, all he has to do is cause the forked support 17, and with it the entire adjustable frame 14, to rotate about a horizontal axis with respect to the base until the position of FIG. 4 is assumed. It is a matter of choice of the person carrying out the invention whether the support rotates with respect to the connector 15 or this latter rotates with respect to the base or still another mechanical solution is adopted. In any case, once the position of FIG. 4 has been assumed, the user can slide the chair to a position in which his legs can fit under a writing desk, while his bust will be in a substantially vertical position, or slightly inclined forward, as required for writing at a desk or other similar activities.

It will be appreciated that the relative position of the components of the chair depends on the position of the telescopic arms, and more specifically of the sliders with respect to the housings, as well as on the orientation or angular position, of the adjustable frame. Locking the telescopic arms, hydraulically or mechanically, e.g. by means of clamps, determines the configuration of the chair, for a given orientation of the adjustable frame, and renders said configuration stable. The orientation of the adjustable frame can be fixed, if so desired, by means of clamps or equivalent means, if frictional resistance to rotation is not considered sufficient.

While an embodiment of the invention has been described by way of illustration, it will be apparent that the invention can be carried out in many other ways by a person skilled in the art, by the use of many mechanical equivalents or alternative mechanical solutions, other than those which have been explicitly mentioned, without departing from the spirit of the invention or exceeding the scope of the appended claims.

We claim:

1. A chair comprising:

a base;

a frame, comprising a fork-shaped support supported by and swingable with respect to said base, and telescopic arms supported in said support and telescopically adjustable to vary their lengths;

a seat and a back connected to one another for relative angular adjustment;

said seat and back being supported by said telescopic arms, whereby telescopic adjustment of said arms permits inclinational variation of said seat and said back.

2. Chair according to claim 1, wherein said seat and back, and a body of a user positioned thereon are supported by the base resting on a floor, and give rise to reaction forces of said floor on said base, said reaction forces having a resultant, and wherein the inclination of said seat and back to such an extent that said resultant passes through or near to the center of gravity of the user's body.

3. Chair according to claim 1, wherein the telescopic arms comprise each a housing and a front and a rear slider and wherein the seat is connected to said front slider and the back is swingably connected to said rear slider, whereby variations of the length of the telescopic arms produces relative swinging motions of the seat and back.

4. Chair according to claim 1, further comprising a head rest connected to the back through at least a pliable zone.

5. Chair according to claim 1, further comprising means for angularly blocking the support relative to the base.

6. Chair according to claim 1, wherein the telescopic arms serve as arm rests.

7. Chair according to claim 1, wherein the support is swingably coupled to a connector slidably supported by the base.

8. Chair according to claim 1, wherein the seat and the back are connected by pliable joints permitting relative angular adjustment thereof.

9. Chair according to claim 1, comprising flexible means supported by the seat and the back for supporting a body of a user.

10. Chair according to claim 1, wherein the telescopic arms each comprise a tubular housing connected to the support and front and back sliders housed in said housing and slidable therein to vary the length of the arm.

11. Chair according to claim 10, comprising hydraulic means for causing the sliders to assume and maintain the desired position with respect to the tubular housings.

12. Chair which comprises a base, an adjustable frame supported by said base, a seat and a back, and is characterized in that the adjustable frame is swingable with respect to the base and comprises telescopic arms, in that the seat and the back are connected to one another for angular adjustment with respect to one another, and in that the seat and the hack are connected to said telescopic arms, whereby adjustment of these latter permits to vary the inclination of the seat and back, wherein the adjustable frame comprises a support, which is supported by the base and is swingable with respect thereto, and wherein the support is fork-shaped.

13. Chair according to claim 12, wherein the support is swingably coupled to a connector slidably supported by the base.

14. Chair which comprises a base, an adjustable frame supported by said base, a seat and a back, and is characterized in that the adjustable frame is swingable with respect to the base and comprises telescopic arms, in that the seat and the back are connected to one another for angular adjustment with respect to one another, and in that the seat and the back are connected to said telescopic arms, whereby adjustment of these latter permits to vary the inclination of the seat and back, wherein the telescopic arms each comprise a tubular housing connected to a support and front and back sliders housed in said housing and slidable therein to vary the length of the arm.

15. Chair according to claim 14, comprising hydraulic means for causing the sliders to assume and maintain the desired position with respect to the tubular housings.

* * * * *

UNITED STATES PATENT AND TRADEMARK OFFICE

CERTIFICATE OF CORRECTION

PATENT NO. : 6,238,001 B1
DATED : May 29, 2001
INVENTOR(S) : Amos Yoran

It is certified that error appears in the above-identified patent and that said Letters Patent is hereby corrected as shown below:

This is a continuation of International Application No. PCT/IL97/00310, filed on September 30, 1997.

Signed and Sealed this

Twenty-second Day of January, 2002

*Attest:*

*Attesting Officer*

JAMES E. ROGAN
*Director of the United States Patent and Trademark Office*